US006688385B1

(12) United States Patent
Moe

(10) Patent No.: US 6,688,385 B1
(45) Date of Patent: Feb. 10, 2004

(54) OIL PRODUCTION TRIP CONTROL BALL

(76) Inventor: Otto A. Moe, 613 Park Ave., Ft. Lupton, CO (US) 80621

( * ) Notice: Subject to any disclaimer, the term of this patent is extended or adjusted under 35 U.S.C. 154(b) by 0 days.

(21) Appl. No.: 09/933,921

(22) Filed: Aug. 21, 2001

Related U.S. Application Data

(60) Provisional application No. 60/226,987, filed on Aug. 22, 2000.

(51) Int. Cl.[7] ..... E21B 43/12

(52) U.S. Cl. ..... 166/53; 166/68; 166/372

(58) Field of Search ..... 166/53, 372, 370, 166/65.1, 68, 105; 417/56, 57, 58

(56) References Cited

U.S. PATENT DOCUMENTS

| | | | | | |
|---|---|---|---|---|---|
| 2,884,861 | A | * | 5/1959 | Vincent et al. | 417/555.2 |
| 3,062,296 | A | * | 11/1962 | Brown | 166/320 |
| 3,095,819 | A | * | 7/1963 | Brown et al. | 137/624.11 |
| 3,147,808 | A | * | 9/1964 | McCarvell et al. | 15/104.061 |
| 3,410,217 | A | * | 11/1968 | Kelley et al. | 417/295 |
| 4,417,858 | A | * | 11/1983 | Stout | 417/56 |
| 5,132,904 | A | * | 7/1992 | Lamp | 166/53 |
| 5,253,713 | A | * | 10/1993 | Gregg et al. | 166/372 |
| 5,984,013 | A | * | 11/1999 | Giacomino et al. | 166/373 |
| 6,209,637 | B1 | * | 4/2001 | Wells | 166/153 |

* cited by examiner

*Primary Examiner*—Hoang Dang
(74) *Attorney, Agent, or Firm*—Patent Law Offices of Rick Martin, P.C.; Rick Martin

(57) ABSTRACT

In a plunger lift oil/gas well a prior art plunger is replaced with a metal ball.

16 Claims, 7 Drawing Sheets

OIL PRODUCTION TRIP CONTROL BALL

CROSS REFERENCE APPLICATIONS

This application is a non-provisional application claiming the benefits of provisional application No. 60/226,987 filed Aug. 22, 2000.

FIELD OF INVENTION

The present invention relates to a plunger lift type oil and gas well, wherein the natural gas/oil pressures from the earth propel the gas/oil to the surface. A metal ball replaces the traditional elongated plunger, wherein the metal ball acts as the interface between the lifting gas in the well's tubing and the liquid column which is lifted upward to harvest.

BACKGROUND OF THE INVENTION

Plunger lift wells are known in the art. They can replace a pumping unit and the associated machinery with a cyclic harvesting system which uses the earth's natural gasses in the deposit layer to push upward a column of oil. The well's tubing may be a mile deep in the earth. The goal of the system is to harvest only one column of liquid at a time. Then a plunger which has risen with that harvested column shuts off the well. The plunger slowly sinks to the bottom of the tubing, thereby allowing the earth's pressure, (250–2000 psi) at the well bottom to replenish. This cycle repeats itself perhaps twice a day. The plunger triggers an arrival sensor at the top of its journey up the well tubing. The arrival sensor shuts off the well head to let the plunger sink to the bottom of the well again. A clearance of thousandths of an inch exists between the plunger and the tubing to enable the liquid under the plunger to pass by the sinking plunger.

Current plungers are relatively expensive multi-part assemblies. See Production Control Services, Inc. at www.pcsplungerlift.com, for a product line description. It is known that elongate plungers wear out the (over a mile long) well tubing, thus causing costly downtime and tubing repairs.

The present invention replaces the elongate plunger assembly with a metal ball having approximately the same diameter as the elongate plunger. Benefits of the present invention include a lower cost and less friction and wear against the inside of the well tube. A ball has less contact area sliding in a pipe than an elongate plunger sliding in the pipe.

SUMMARY OF THE INVENTION

The main aspect of the present invention is to provide a ball to replace an elongate plunger in a plunger lift type well.

Another aspect of the present invention is to provide a ball fishing apparatus to retrieve the ball at the bottom of the well tubing during maintenance.

Other aspects of this invention will appear from the following description and appended claims, reference being made to the accompanying drawings forming a part of this specification wherein like reference characters designate corresponding parts in the several views.

The general advantages of a plunger lift well are:

Low maintenance cost. On average less than $1000 per year.

Increases the well's own lifting efficiency.

Easy installation when seating nipple or tubing stop is in the hole.

Reduces paraffin or hot oil expense.

No external energy (expense) required.

Produces most wells to depletion.

Replaces pumping units on most gas wells.

Slows well decline.

Extends the lift of the well.

In operation a plunger is removed from a plunger lift type well during a closed part of the plumping cycle. A stainless steel ball having the same diameter as the plunger is put in the well tubing. The ball falls (in perhaps one hour to half a day) to the well bottom. The well head is opened to allow the harvest of one column of oil. When the ball trips the arrival sensor (just like the plunger did), the well head is shut off. The only other change to the plunger lift system to accommodate the ball is to add a safety bar(s) on the inside of the well head piping to preclude the passage of the ball beyond the confines of the vertical tubing. New systems may be designed with the ball, and may provide a wider inside diameter at the well bottom (based on projections) which would increase the throughput of the well.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE PREFERRED EMBODIMENT

Figure 1:
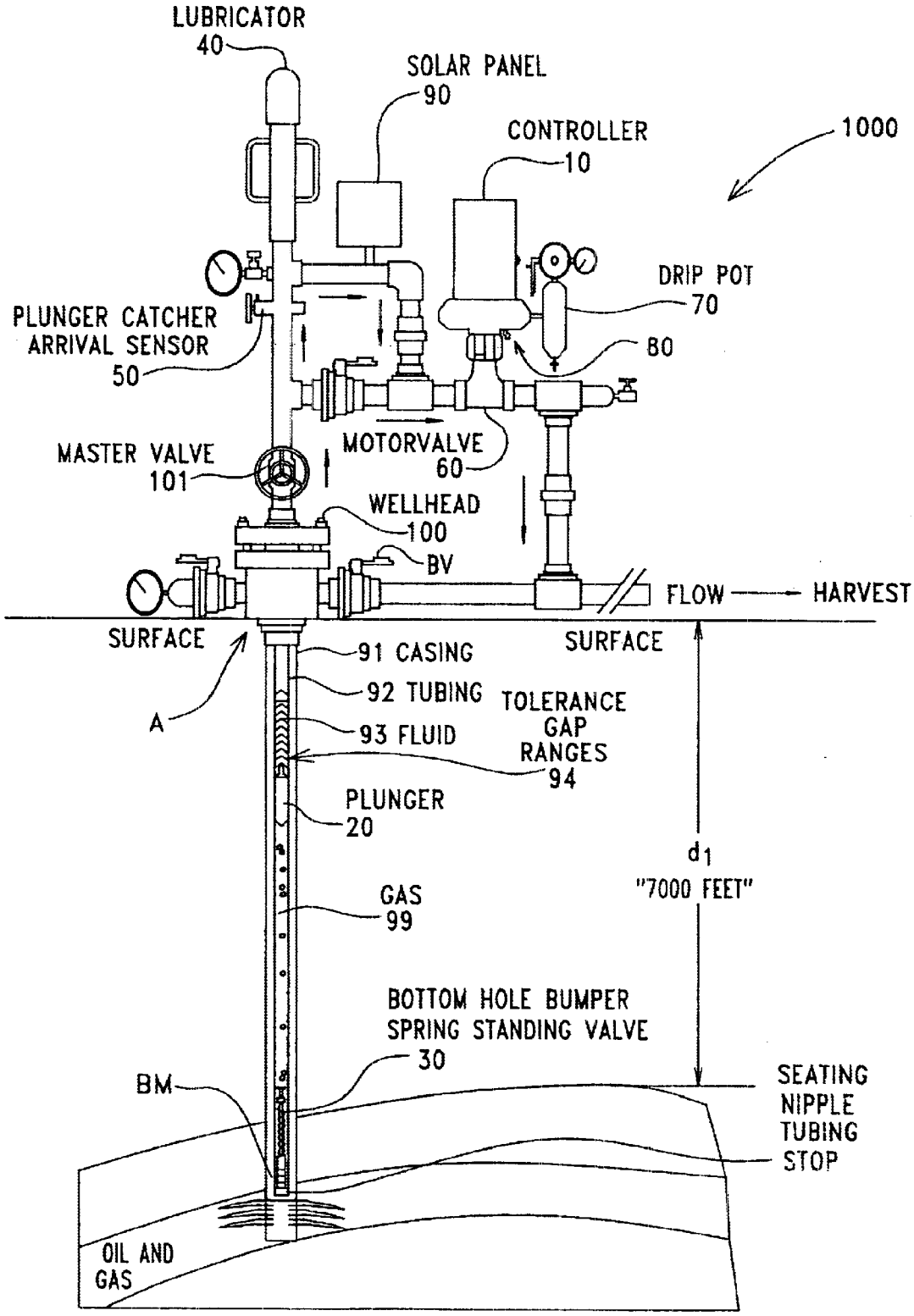
FIG. 1 (PRIOR ART)
FIG. 1 (prior art) is a schematic drawing of a plunger lift well including the well head machinery.

Referring first to FIG. 1 a prior art plunger lift system is described. Wells exhibiting any or all of the following producing characteristics should be considered as a possible plunger lift candidate:

Wells where blow downs to atmosphere are required to restore production;

Formation gas and liquid ratio at least 400 cubic feet of gas per barrel per 1000 feet to be lifted;

Shut-in wellhead pressure of an least 1.5 times sales line pressure;

Wells producing by heading cycle with decreasing production rates;

Paraffin, salt, or scale problem wells;

Heavily deviated wells;

Remote wells; and

Marginal wells using a pumping unit.

A brief overview of the FIG. 1 prior art system 1000 follows below.

10—CONTROLLER

Programmed to open and close well on time or pressure cycles.

Designed to provide more well history to help field personnel optimize production, minimizing time spent at well location.

Easily programmed: designed with simplicity and reliably in mind.

LCD read-out displays current status of the system.

20—PLUNGER

Forces the liquid load as one slug to the surface, minimizing fall back.

Acts as an interface between the liquid column and the lifting gas.

Used as an indicator to operate the arrival sensor and controller.

Keeps tubing free of salt, scale, or paraffin build-up. Increases gas sales by continually removing all liquids.

30—BOTTOM HOLE BUMPER SPRING

Designed to protect the tubing and plunger from impact.

Also available with ball and seat to retain liquid in the tubing.

Tubing or collar stop can be installed if no seating nipple exists.

40—LUBRICATOR

Used for plunger inspection and to house the catcher and sensor.

Spring loaded, removable cap absorbs plunger impact. Single or double flow outlet options.

50—ARRIVAL SENSOR

Senses the arrival of the plunger.

Signals the controller to reset to the proper mode for gas sales or shut in.

60—MOTOR VALVE

Pneumatic diaphragm activated valve to open or close gas and oil flow.

Acts to drop plunger when motor valve closes.

70—DRIP POT ASSEMBLY

Used to trap condensate from supply gas.

Regulates supply gas at 35 PSI to controller.

80—FLOW CONTROLLER (PSI Reducing Pilots)

Keeps the gas sales chart from fluctuating making integration easier.

Controls plunger velocity for optimum efficiency.

90—SOLAR PANEL

Keeps batteries at peak performance for reliable operation.

The well head machinery A is standard for a plunger lift well. Note that a pump is not needed. The distance $d_1$ of casing 91 might be 7000 feet with a pressure entering the bottom hole BH ranging from 250–2500 psi. The tolerance gap 94 for a 2 1/16 tubing is the delta from tube ID to connection OD.

| 2 1/16" Tubing | | | | | |
|---|---|---|---|---|---|
| Nominal weight | Thread Type | Tube OD | Tube ID | Connection OD | Connection ID |
| 3.25# | 10rd IJ | 2.063 | 1.75 | 2.325 | 1.657 |
| 3.25# | CS Hydril | 2.063 | 1.75 | 2.33 | 1.7 |
| 4.50# | CS Hydril | 2.063 | 1.613 | 2.46 | 1.55 |

Figure 2:
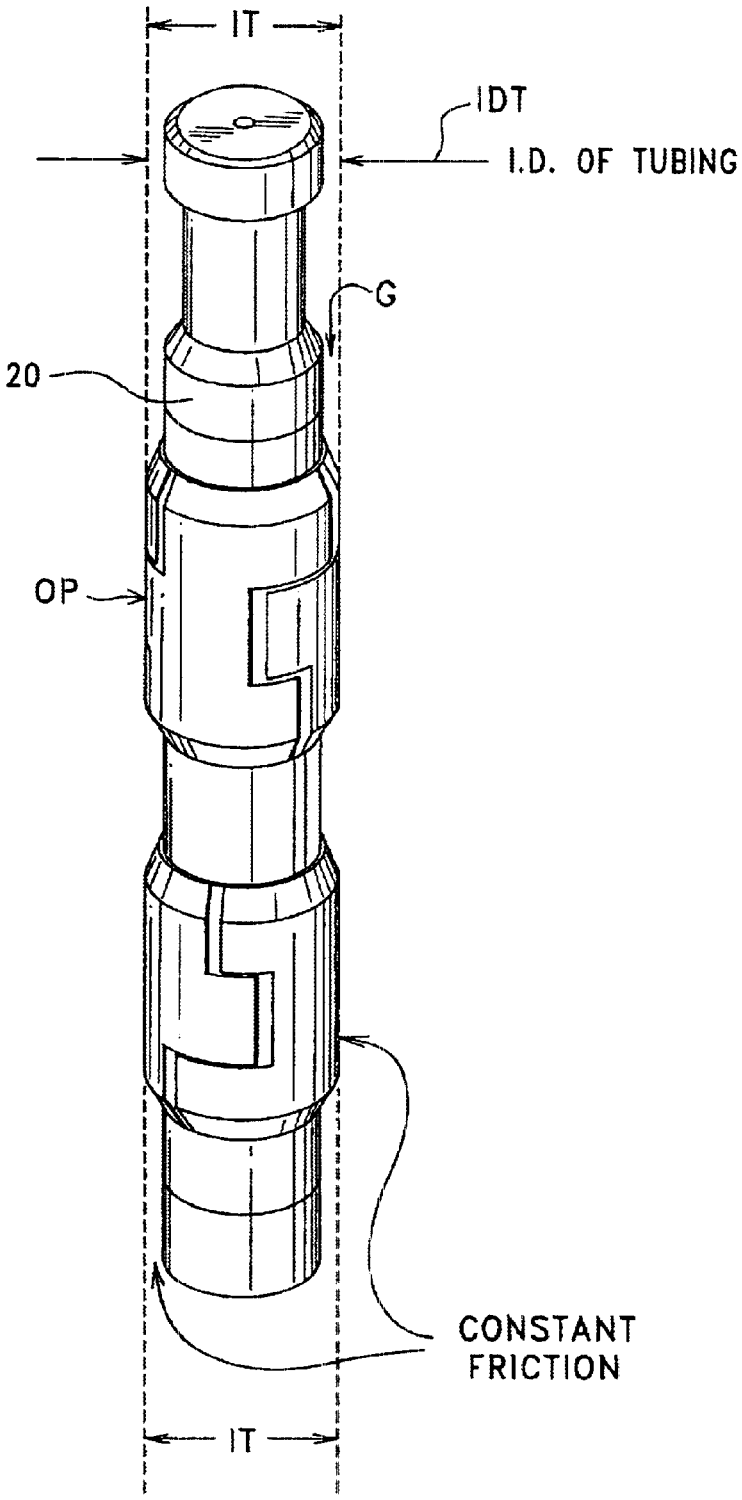
FIG. 2 (PRIOR ART)
FIG. 2 (prior art) is a top perspective view of a typical plunger used in the FIG. 1 well.

The plunger 20 may make a round trip twice a day in continuous operation. Referring next to FIG. 2 (prior art) the plunger 20 is seen to consist of multiple pieces. If a piece is lost, then the well is down awaiting parts. The I.D. of the tubing is seen with arrows IDT. The gap G is where the liquid seeps by during the sinking of the plunger 20 when the well is in the "OFF" cycle. A constant friction occurs along the inside of the tubing IT and the outside of the plunger OP. This friction causes wear on the tubing and leads to repairing/replacing the tubing.

Figure 3:
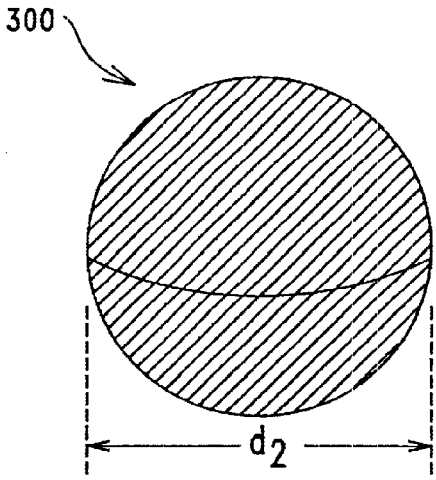
FIG. 3 is a top perspective view of the preferred embodiment stainless steel trip ball.

The preferred embodiment trip ball 300 is shown in FIG. 3. The preferred material of construction is stainless steel, and or iron. The diameter $d_2$ is generally slightly less than the inside diameter of the tubing. This diameter ranges from ½–8 inches.

Figure 4:
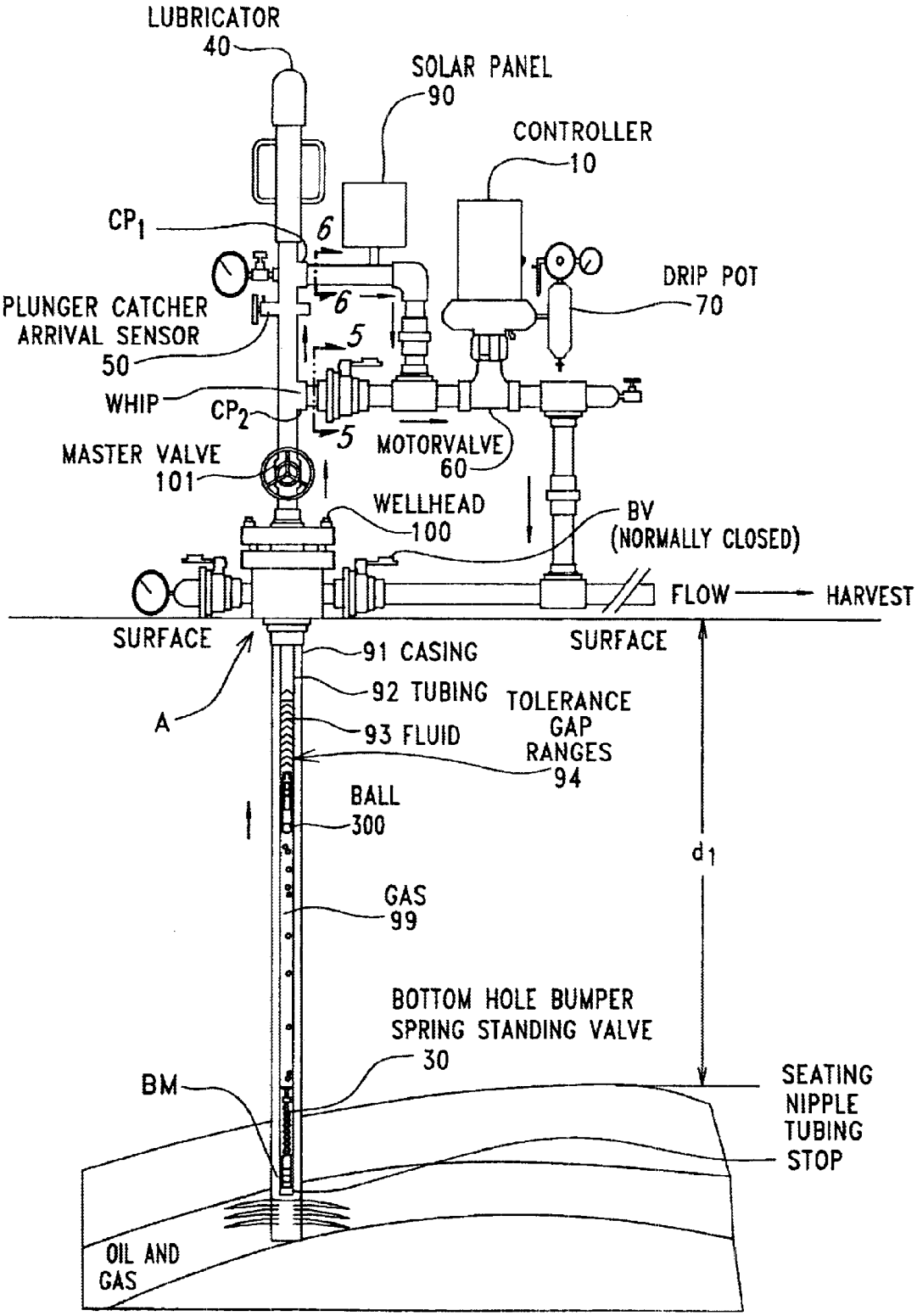
FIG. 4 is the same view as FIG. 1 with the preferred embodiment replacing the plunger.

In FIG. 4 the gas 99 pushes the trip ball 300 up the tubing 92 during an "ON" cycle for harvesting one column of oil (fluid 93) in the tubing 92. The casing 91 is installed down the well hole after drilling, then the tubing is installed. The wellhead 100 is standard as is the master valve 101. The bottom hole bumper 30 may be eliminated in the preferred embodiment well system, thus saving costs.

The connecting pipe fittings $CP_1$,$CP_2$ extend from the primary wellhead pipe WHP. These connecting pipe fittings $CP_1$,$CP_2$ and all like fittings need to have a ball block rod installed in them to prevent the trip ball 300 from traveling downstream.

To summarize the operation the trip ball 300 is closed into the well head pipe-WHP to replace a plunger (or for a new system no plunger is replaced). The trip ball falls to the bottom of the tubing where the bottom hole bumper spring may have been removed as unnecessary. The controller 10 tells the system to begin the "ON" cycle. The motor valve 60 opens the well up, wherein the bypass valve BV is normally closed. The trip ball 300 is thrust off the bottom of the tubing, thus lifting fluid 93 (oil) to the wellhead 100. The trip ball 300 triggers the arrival sensor 50. The controller 10 shuts off the motor valve 60. During the ON cycle a column or oil has been harvested at HARVEST. The trip ball 300 drops back to the bottom of the tubing ready to repeat the cycle.

Figure 5:
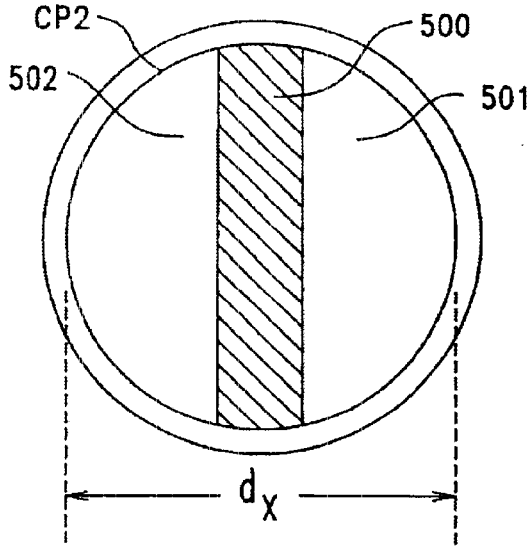
FIG. 5 is a cross sectional view of pipe taken along line 5—5 of FIG. 4.

Referring next to FIG. 5 the fitting $CP_2$ has an I.D. ($d_x$) larger than the O.D. of the trip ball 300 (see FIG. 3). Therefore, a rod 500 is welded in to block the trip ball from leaving the wellhead pipe WHP. Cavities 501,502 allow the oil to flow to HARVEST. If the I.D. ($d_x$) is smaller than the O.D. of the trip ball, then the rod 500 may not be needed.

Figure 6:
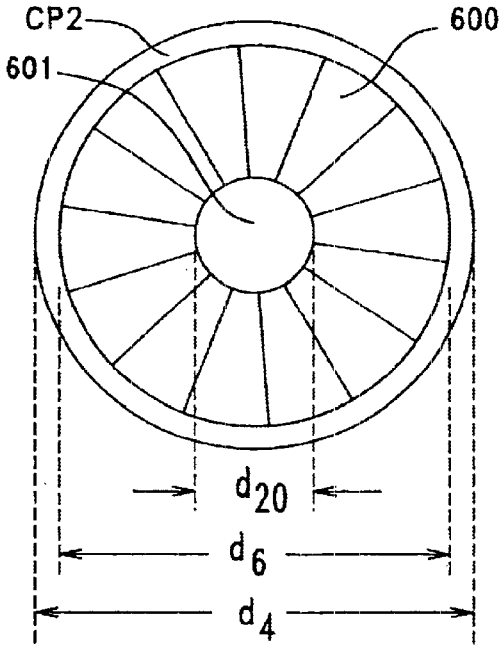
FIG. 6 is a cross sectional view of pipe taken along line 6—6 of FIG. 4.

Referring next to FIG. 6 the fitting $CP_2$ has an I.D. ($d_6$) larger than the O.D. of the trip ball; 300 (see FIG. 3). A heavy wall pipe 600 has been used in the forming of fitting $CP_2$ so as to reduce the I.D. ($d_{20}$) to smaller than the O.D. of the trip ball 300. The O.D. ($d_4$) of the fitting $CP_2$ is usually two inches. The oil flows through orifice 601.

Figure 7:
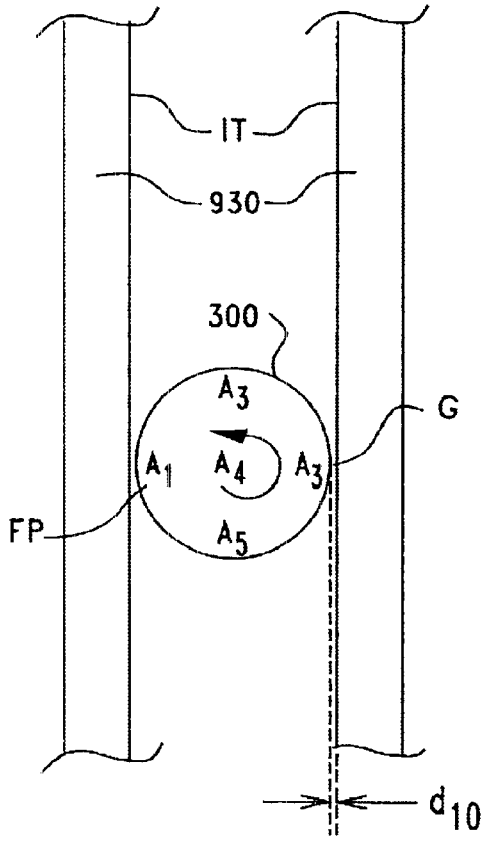
FIG. 7 is a side plan view of the preferred embodiment in a well tubing.

Referring next to FIG. 7 the inside surface IT of the tubing 930 used in other figures is shown as is the gap G between the trip ball 300 and the inside surface IT of the tubing 930. Trip ball 300 is rotated in direction $A_4$ during a moment in its travel. Of the ball's surface points $A_1$,$A_2$,$A_3$,$A_5$ only one point ($A_1$, for example) touches the inside surface IT at friction point FP. And for some moments no points would touch the inside surface IT. Thus, less friction and wear on the tubing occurs compared to any elongate plunger of the prior art. Gap G ($d_{10}$) may be 25/1000 inch or larger at any given point in time.

Figure 8:
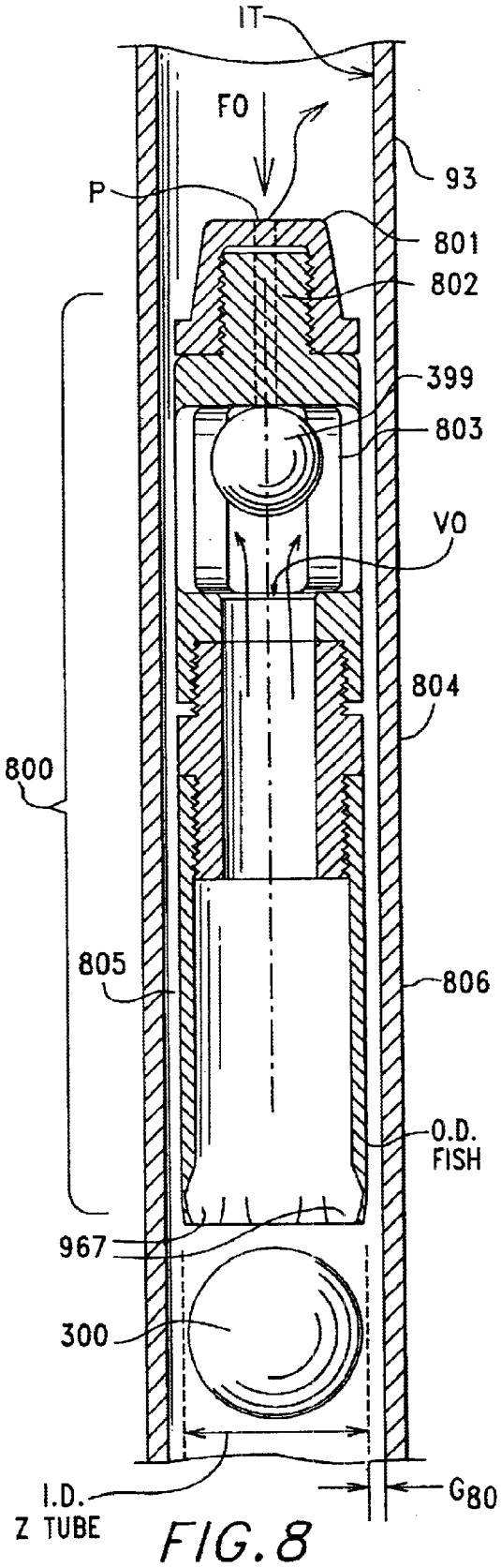
FIG. 8 is a longitudinal sectional view of a ball fishing device traveling downward in a well tubing.
Figure 9:
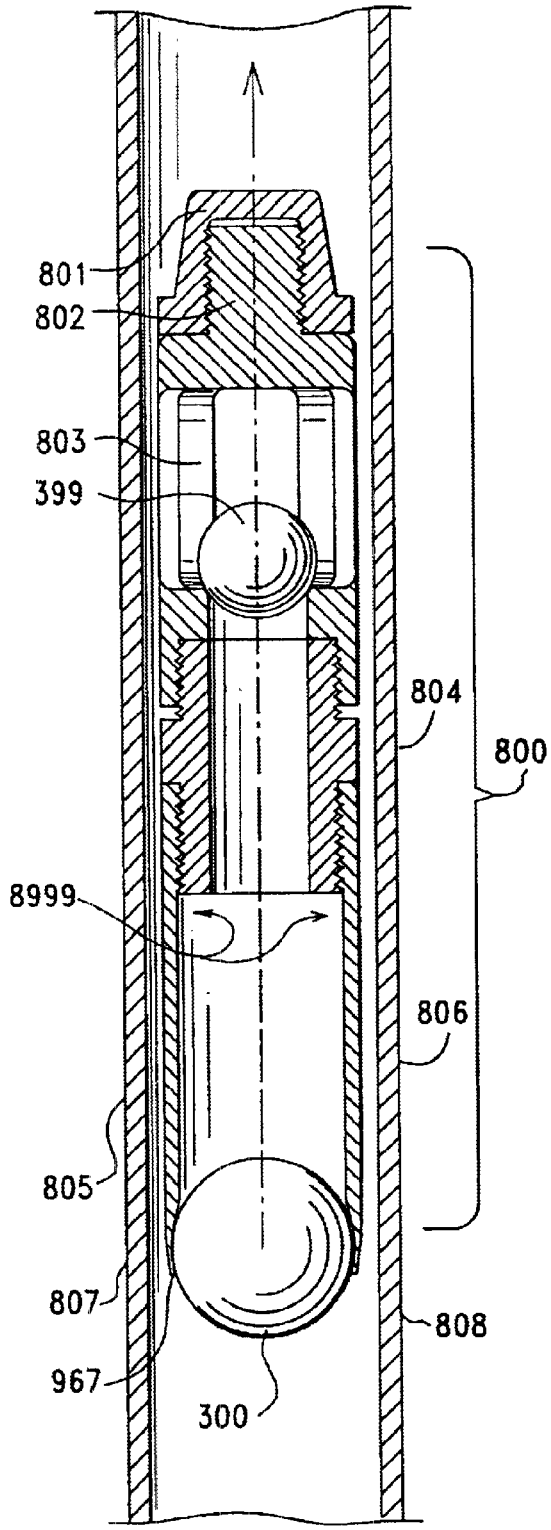
FIG. 9 is the same view as FIG. 8 with the ball fishing device locking and carrying upward the ball.

Referring next to FIGS. 8,9 a trip ball fishing tool 800 is used to retrieve the trip ball 300 when it rests at the bottom of the tubing against any firm base (tubing outlet or bottom hole bumper). In FIG. 8 the fishing tool 800 is being lowered down the tubing 93. The I.D. of tubing (I.D. TUBE Z) is 1.657 inch for a 2 1/16 inch O.D. tube. The O.D. of the fishing tool (O.D. FISH) is 1.64 inch, wherein the gap $G_{80}$ therebetween is 17/1000 inch.

The cap 801 is suited to connect to a drop shaft (not shown). A ball valve housing 802 secures a ball valve 803 having a valve opening VO, a ball 399 and an output channel P. In FIG. 8 the arrows OF stand for fluid out as the fishing tool 800 is lowered, and the ball 399 is lifting out of the valve opening VO.

A further housing 804 supports a cylindrical bowl 8999 having clamp halves 805,806, wherein a larger ball would require a third clamp member (not shown). In FIG. 9 the lower ends 807,808 of clamp halves 805,806 have clamped the ball 300, wherein fingers 967 have a spring load, and have clasped the ball. The fishing tool 800 is raised, thus lowering ball 399 to close the valve opening VO. The trip ball 300 is fished up. Fluid can pass by the fishing tool 800 via gap $G_{80}$ and/or the fluid during fishing can be harvested out the wellhead.

Figure 10:
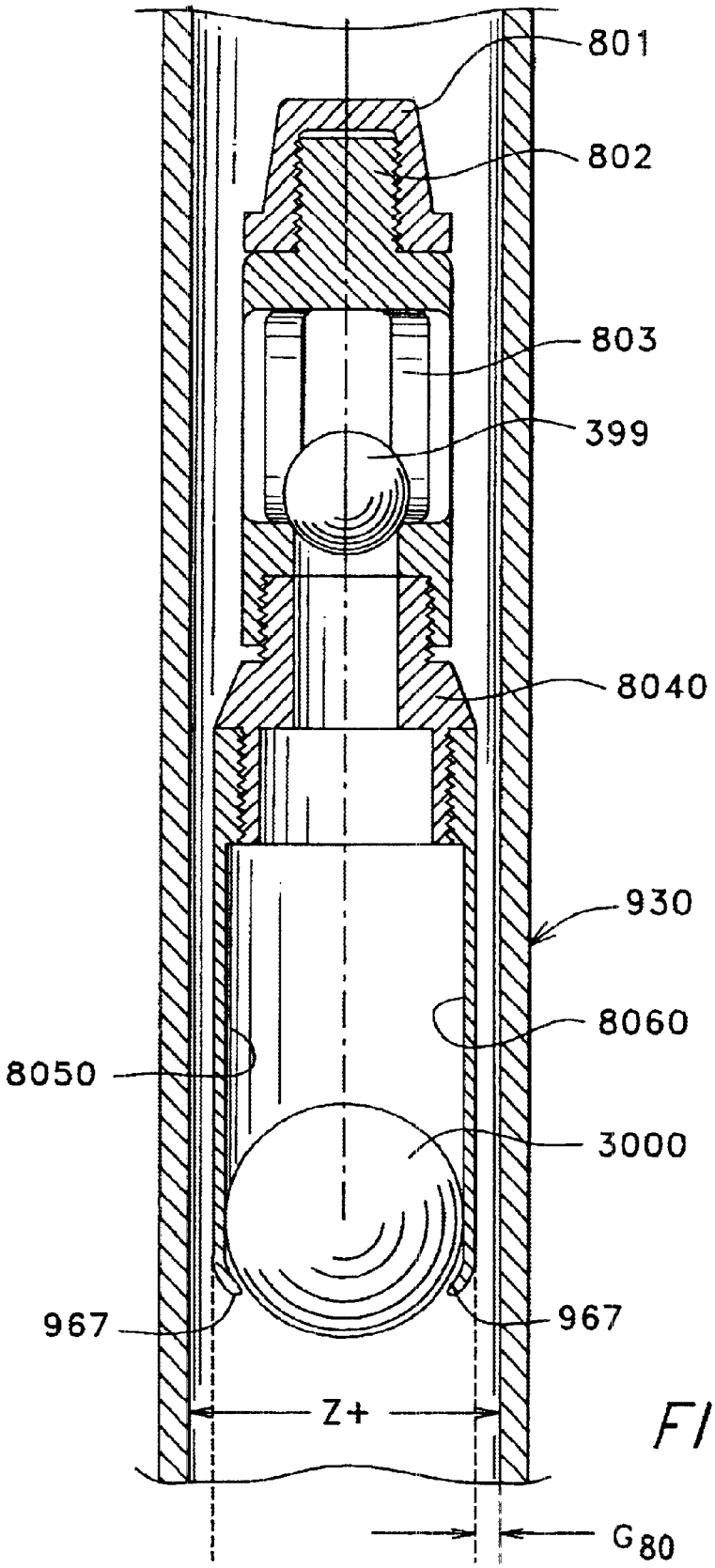
FIG. 10 is a longitudinal sectional view of an alternate embodiment ball fishing device.

In FIG. 10 a larger tube 930 has an inside diameter Z+(which is larger than Z of FIGS. 8,9). The housing 8040 is appropriately wider to keep the gap G80 about the same size. Clamp halves 8050,8060 are equivalent to halves 805,806. Ball 3000 is bigger than ball 300.

Figure 11:
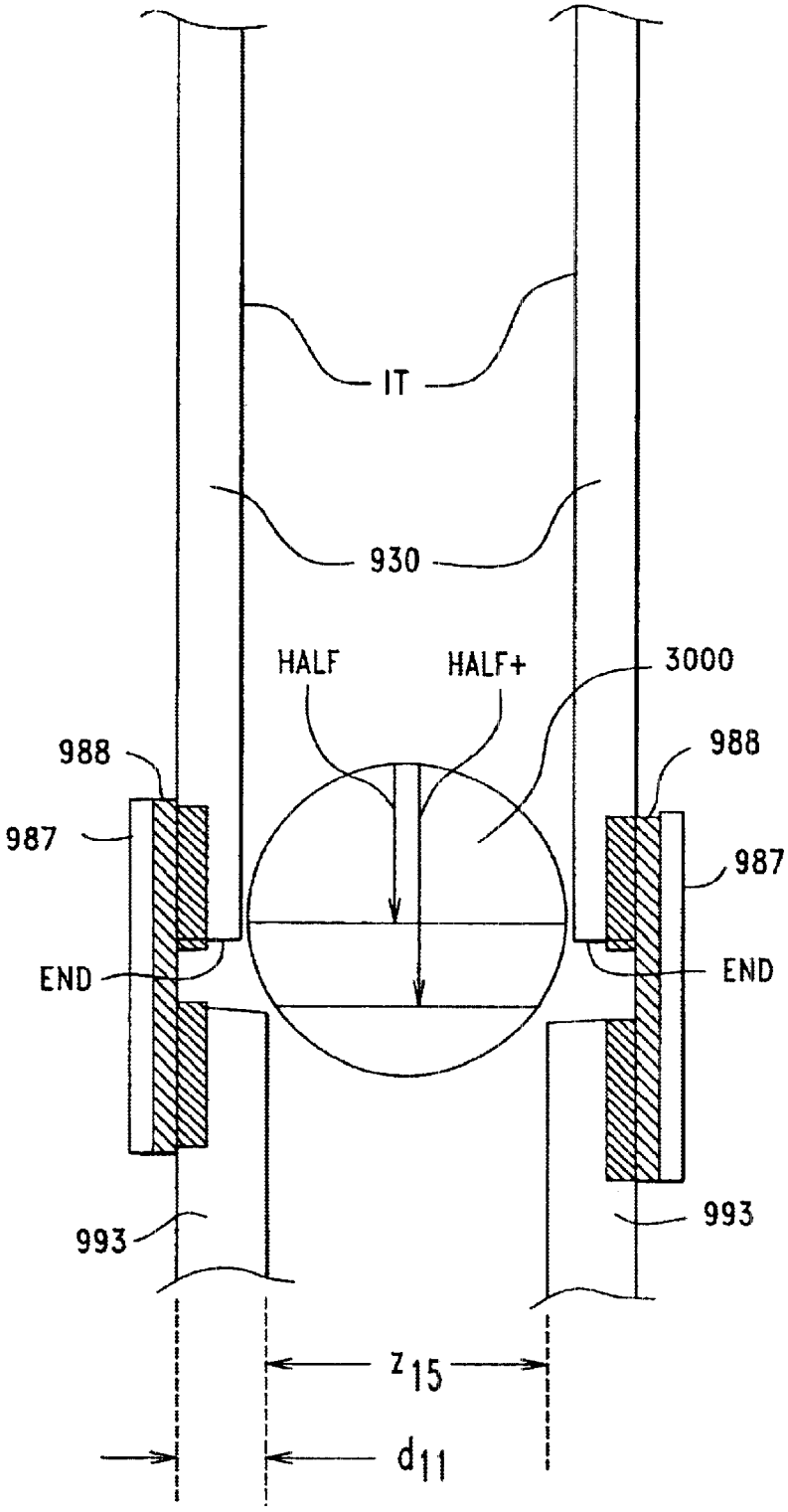
FIG. 11 is a side plan of the ball stop at the bottom of the tubing.

Referring next to FIG. 11 the tubing 930 ends at END, wherein a collar 987 having threads 988 is threaded onto the tubing 930. A cylindrical seating nipple 993 is threaded into the collar 987. The walls of the seating nipple have a diameter $d_{11}$, to create a smaller inside diameter Z 15 than the I.D. of ball 3000. A pedestal PED is created to seat the ball 3000. More than half the diameter of the ball 3000 as indicated by HALF and HALF+must sit above the pedestal PED for proper seating. Nominal dimensions are ball=1½"; I.D. of tubing is 1.657"; $Z_{15}$=1¼"; $h_{10}$=1 foot Advantages 1. Low cost & will save big money.
2. Wears evenly & should last longer.
3. Very little wear on tubing only a pinhead will touch tubing.
4. One piece means no pieces to loose.
5. Easy to fish only need to go over half the ball.
6. Better in sand.
7. Better in paraffin no displacement.
8. Could eliminate bumper spring others you can't.
9. Could give well a bigger I.D. at bottom of hole.

Although the present invention has been described with reference to preferred embodiments, numerous modifications and variations can be made and still the result will come within the scope of the invention. No limitation with respect to the specific embodiments disclosed herein is intended or should be inferred.

I claim:

1. In combination with a cycle lifting oil/gas well having a tubing inserted into an underground reservoir to lift a fluid/gas mixture, said tubing capped with a wellhead assembly having a primary wellhead pipe (WHP), said WHP having an arrival sensor which triggers a controller programmed to open and close the well on time or pressure cycles, an improvement comprising:

a trip ball cyclable up and down the tubing;

said trip ball having an outside diameter slightly smaller than an inside diameter of the tubing;

wherein a pressure from the reservoir pushes the trip ball up the tubing during a harvest cycle;

said trip ball switches the arrival sensor, thereby ending the harvest cycle;

a stop in the WHP to limit a travel of the trip ball;

wherein the trip ball is a metal sphere heavier than the fluid/gas mixture;

wherein the tubing further comprises a seating nipple having an inside diameter smaller than the outside diameter of the trip ball;

wherein the seating nipple inside diameter further comprises a diameter suited to stop the trip ball with more than half the trip ball projecting upward from the seating nipple;

wherein the seating nipple further comprises a location at a lowermost end of the tubing;

a trip ball fishing tool insertable into the tubing; and wherein the trip ball fishing tool further comprises a ball valve assembly which opens during a descent and closes during a retrieve operation.

2. The improvement of claim 1, wherein the stop is a cross bar in the WHP.

3. The improvement of claim 1, wherein the stop is a WHP segment having an inside diameter smaller than the outside diameter of the trip ball.

4. The improvement of claim 1, wherein the trip ball is made of stainless steel.

5. The improvement of claim 1, wherein the trip ball outside diameter is 25/1000 inch or less than the inside diameter of the tubing.

6. The improvement of claim 1, wherein the trip ball fishing tool further comprises a pair of clamp halves sized to grasp the trip ball.

7. In combination with a cyclic lifting-oil/gas well having a tubing inserted into an underground reservoir to lift a fluid/gas mixture, said tubing capped with a wellhead assembly having a primary wellhead pipe (WHP), said WHP having an arrival sensor which triggers a controller programmed to open and close the well on time or pressure cycles, an improvement comprising:

a trip ball means functioning to cycle up and down the tubing;

said trip ball means having an outside diameter slightly smaller than an inside diameter of the tubing;

wherein a pressure from the reservoir pushes the trip ball means up the tubing during a harvest cycle;

said trip ball switches the arrival sensor, thereby ending the harvest cycle;

a stop means in the WHP functioning to limit a travel of the trip ball;

wherein the trip ball means is a metal sphere heavier than the fluid/gas mixture;

wherein the tubing further comprises a seating nipple means having an inside diameter smaller than the outside diameter of the trip ball and functioning to support the trip ball means:

wherein the seating nipple means inside diameter further comprises a diameter suited to stop the trip ball means with more than half the trip ball means projecting upward from the seating nipple means;

wherein the seating nipple means further comprises a location at a lowermost end of the tubing;

a trip ball fishing tool means insertable into the tubing functioning to retrieve the trip ball means; and wherein the trip ball fishing tool means further comprises a ball valve means functioning to open during a descent and close during a retrieve operation.

8. The improvement of claim 7, wherein the stop means is a cross bar in the WHP.

9. The improvement of claim 7, wherein the stop means is a WHP segment having an inside diameter smaller than the outside diameter of the trip ball.

10. The improvement of claim 7, wherein the trip ball means is made of stainless steel.

11. The improvement of claim 7, wherein the trip ball means outside diameter is $^{25}/_{1000}$ inch or less than the inside diameter of the tubing.

12. The improvement of claim 7, wherein the trip ball fishing tool means further comprises a clamp means functioning to grasp the trip ball.

13. In combination with a cyclic lifting oil/gas well having a tubing inserted into an underground reservoir, said tubing capped with a wellhead assembly having a primary wellhead pipe (WHP), said WHP having an arrival sensor, an improvement comprising:

a trip ball cyclable up and down the tubing;

said trip ball having an outside diameter slightly smaller than an inside diameter of the tubing;

wherein a pressure from the reservoir pushes the trip ball up the tubing during a harvest cycle;

said trip ball switches the arrival sensor, thereby ending the harvest cycle;

a stop in the WHP to limit a travel of the trip ball;

wherein the tubing further comprises a seating nipple having an inside diameter smaller than the outside diameter of the trip ball;

wherein the seating nipple inside diameter further comprises a diameter suited to stop the trip ball with more than half the trip ball projecting upward from the seating nipple;

a trip ball fishing tool insertable into the tubing; and wherein the trip ball fishing tool further comprises a ball valve assembly which opens during a descent and closes during a retrieve operation.

14. The apparatus of claim 13, wherein the trip ball fishing tool further comprises a pair of clamp halves sized to grasp the trip ball.

15. In combination with a cyclic lifting oil/gas well having a tubing inserted into an underground reservoir, said tubing capped with a wellhead assembly having a primary wellhead pipe (WHP), said WHP having an arrival sensor, an improvement comprising:

a trip ball means functioning to cycle up and down the tubing;

said trip ball means having an outside diameter slightly smaller than an inside diameter of the tubing;

wherein a pressure from the reservoir pushes the trip ball means up the tubing during a harvest cycle;

said trip ball switches the arrival sensor, thereby ending the harvest cycle;

a stop means in the WHP functioning to limit a travel of the trip ball;

wherein the tubing further comprises a seating nipple means having as inside diameter smaller than the outside diameter of the trip ball and functioning to support the trip ball means;

wherein the seating nipple means inside diameter further comprises a diameter suited to stop the trip ball means with more than half the trip ball means projecting upward-from the seating nipple means;

a trip ball fishing tool means insertable into the tubing functioning to retrieve the trip ball means; and wherein the trip ball fishing tool means further comprises a ball valve means functioning to open during a descent and close during a retrieve operation.

16. The apparatus of claim 15, wherein the trip ball fishing tool means further comprises a clamp means functioning to grasp the trip ball.

* * * * *